252-99 AU 165 EX
11/2/76 XR 3,989,634

United States Patent [19]
Prochazka et al.

[11] 3,989,634
[45] Nov. 2, 1976

[54] DETERGENT CONTAINING A TENSIDE WITH ACTIVATING POWER

[75] Inventors: Karel Prochazka, Krivoklat; Jan Novak, Prague; Jaroslav Simunek, Rakovnik; Vlastimil Peterka, Roztoky u Krivoklatu; Vaclav Krob, Nesuchyne, all of Czechoslovakia

[73] Assignee: Tukovy prumysl, oborove reditelstvi, Prague, Czechoslovakia

[22] Filed: Aug. 12, 1974

[21] Appl. No.: 496,548

Related U.S. Application Data

[63] Continuation-in-part of Ser. No. 301,636, Oct. 27, 1972, abandoned.

[52] U.S. Cl. ..... 252/89 R; 252/110; 252/117; 252/97; 252/99; 252/527; 252/546; 252/DIG. 11

[51] Int. Cl.[2] ..... C11D 3/08; C11D 7/18; C11D 9/08

[58] Field of Search ..... 252/110, 89, 117, 527, 252/546, 97, 99, DIG. 11

[56] References Cited

UNITED STATES PATENTS

| | | | |
|---|---|---|---|
| 2,396,938 | 3/1946 | Bersworth | 252/89 X |
| 2,808,435 | 10/1957 | Young, Jr. | 252/89 X |
| 3,637,339 | 1/1972 | Gray | 252/97 X |
| 3,684,723 | 8/1972 | Best et al. | 252/97 X |
| 3,697,217 | 10/1972 | Maddox | 252/97 X |

*Primary Examiner*—Mayer Weinblatt

[57] ABSTRACT

This invention relates to a detergent containing a tenside which evidences an activating power which is distinct from the common properties of surface-active agents. More particularly, the present invention relates to a detergent containing a tenside which manifests the ability to form complex compounds with metal cations.

4 Claims, No Drawings

DETERGENT CONTAINING A TENSIDE WITH ACTIVATING POWER

This application is a continuation-in-part of copending application, Ser. No. 301,636, filed Oct. 27, 1972, now abandoned.

Among the most common tensides utilized heretofore in the manufacture of detergents is soap. Unfortunately the stability of soap in the presence of hard water is limited, thereby restricting its range of utilization. Accordingly, workers in the detergent arts have focused their attention with increasing frequency and interest upon the use of synthetic tensides rather than soaps in the preparation of detergents.

The detergents which are currently used commercially evidence high degrees of activity and efficiency and include therein a wide variety of components, typically including polymeric phosphates (organic and inorganic), polyelectrolytes, alkaline silicates and conventional additives and electrolytes.

Processing techniques for preparing detergents from a variety of required raw materials generally pose technological difficulties, for example, transport, storage and accurate dosage of the materials, both pulverized and liquified, and the homogenization thereof. Perhaps the simplest procedure for homogenizing such raw materials is found in the preparation of liquid detergents wherein the ingredients are permitted to dissolve in an aqueous medium contained in a suitable vessel equipped with an agitator, the medium being maintained at its boiling temperature.

Unfortunately, these liquid detergents are not entirely satisfactory in that they contain a high content of activating additives which are prone to provoking tenside graining and the crystallization of inorganic compounds from the medium. This accounts for the fact that liquid detergents evidence a lower efficiency than pulverized detergents and, consequently, are manufactured in smaller quantities than the latter.

Nonetheless, the preparation of pulverized detergents is a far more exacting process in which three fundamental technological concepts are employed, namely, a. cold atomization (crystallization),
b. hot atomization in a drying tower, and
c. mixing the pulverized raw materials while simultaneously spraying the mixture with liquid constituents (spray mixing).

It will be appreciated by those skilled in the art that the aforementioned processes may be combined with each other. The cold atomization process, although of interest to early workers in the art, has now been abandoned due to the fact that its applicability was limited to a narrow product range. The hot atomization process also suffers from limitations in that it requires large capital expenditures for physical plants and imposes excessive power demands. The spray mixing process is gaining in popularity; however, its primary application has involved the use of products prepared by hot atomization in drying towers.

In accordance with the present invention, these prior art limitations have been substantially lessened or eliminated by the use of a detergent containing a tenside evidencing activating power in combination with conventional activators, softeners, fillers, odoriferous materials, coloring components, brighteners, disinfectants, surfactants, biologically active substances, or mixtures thereof. The described detergents comprise from 3 – 99%, by weight, of a tenside evidencing activating power and having a general formula selected from the group consisting of

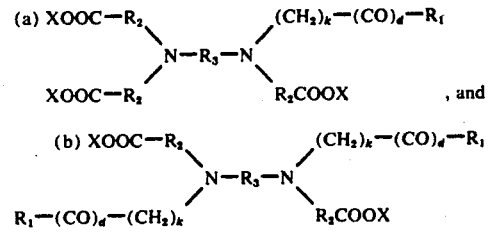

(a) $XOOC-R_2$, $XOOC-R_2$, $N-R_3-N$, $(CH_2)_k-(CO)_d-R_1$, $R_2COOX$, and (b) $XOOC-R_2$, $R_1-(CO)_d-(CH_2)_k$, $N-R_3-N$, $(CH_2)_k-(CO)_d-R_1$, $R_2COOX$ wherein $R_1$ is selected from the group consisting of CTHtS (1)

$$CH_3(CH_2)_n-\left[O-\underset{\underset{CH_3}{|}}{CH_2CH_2}\right]_m-(OCH_2CH_2)_p-O-, \quad (2)$$

and (3) $CH_3-C_rH_t-C_6H_4$ wherein $k$ is an integer from 0 – 20, $d$ is an integer from 0 – 1, $n$ is an integer from 1 – 30, $m$ is an integer from 0 – 90, $p$ is an integer from 0 – 30, $r$ is an integer from 6 – 30, $t$ is an integer from 8 – 58, the sum of the carbon atoms in $R_1$ and $k$ being at least 8, the sum of $n$, $m$ and $p$ being at least 4, the sum of $m$ and $p$ being at least 1, and S is selected from the group consisting of H—, —NH—, and —0—, $R_2$ is an alkyl radical having from 1-3 carbon atoms, $R_3$ is selected from the group consisting of 1. alkyl radicals having from 2 – 4 carbon atoms, and

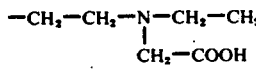

$$-CH_2-CH_2-\underset{\underset{CH_2-COOH}{|}}{N}-CH_2-CH_2-, \quad (2)$$

and X is selected from the group consisting of alkali metals, hydrogen, an amonium radical and mono, di and triethanolammonium radicals.

The primary advantage of the described detergents as compared with conventional prior art detergents is that the former possesses a high degree of efficiency in the absence of large quantities of expensive activating additives. As a result, preparation of detergents including tensides having activating power can be restricted to chemical preparation of tensides admixed with minor amounts of diverse ingredients such as optical brighteners and perfuming substances. Thus, it will be understood by those skilled in the art that the necessity for large capital expenditures for physical plants, and transport and storage of materials, the major limitations of prior art detergent manufacturing processes, has now been obviated. Additionally, the present invention permits manufacture of highly effective liquid detergents by merely dissolving tensides, perfumes, optical brighteners and coloring substances in water or another solvent, the pH of the solution being optionally adjusted.

In recent years, governmental agencies, particularly in the United States, Canada, Sweden and Finland have been faced with severe eutrophication of lakes and streams, such being attributed to the high phosphorus content thereof. Unfortunately, one of the primary sources of the deleterious phosphorous derivatives is the activator commonly employed in the commercially available detergents, namely, polymeric phosphates. The instant invention contributes to the alleviation of this problem and hence is of significant interest to environmentalists.

The detergents described herein may also optionally be combined with conventional detergents to which only minimal quantities of the conventional activating ingredients have been added.

The invention will be more readily understood by reference to the following exemplary embodiments. It will be understood that these examples are set forth solely for purposes of exposition and are not to be construed as limiting. All parts given in the following examples are parts, by weight.

EXAMPLE I 45 parts of the trisodium salt of the mono-octadecyl amide of ethylene diamine tetraacetic acid were dissolved in 50.6 parts of warm water (50° C) maintained in a kettle equipped with an agitator. Then, 0.2 parts of an optical brightener dissolved in 4 parts of ethanol and 0.2 parts of a perfume were added to the mixture. The resultant product was found to be a highly effective liquid detergent.

EXAMPLE II

To a kettle equipped with an agitator, there was added 10 parts of the trisodium salt of lauryl ethylene diamine triacetic acid, 8 parts of sodium tri-polyphosphate, 5 parts of sodium metasilicate, 14 parts of sodium sulfate, 1 part of carboxymethyl cellulose, 0.2 parts of optical brighteners, 8 parts of sodium carbonate and 53.8 parts of water. The resultant mixture was then atomized and, subsequently, dried in a conventional spray drier. The resultant product was a detergent powder evidencing a high degree of efficiency.

EXAMPLE III

In a conventional mixer, there were admixed 10 parts of the trisodium salt of octadecyl ethylenediamine triacetic acid, 2 parts of soap, 10 parts of sodium tripolyphosphate, 8 parts of sodium metasilicate, 2.5 parts of a copolymer of ethylene and the sodium salt of maleic acid, 2 parts of carboxymethyl cellulose, 10 parts of sodium carbonate, 25 parts of sodium perborate, and 24 parts of sodium sulfate. The resultant mixture was then sprayed with a mixture comprising 2 parts of ethylene oxidated nonylphenol, 0.2 parts of perfume and 0.3 parts of optical brighteners. The resultant product was a detergent powder evidencing a high degree of efficiency.

Although the invention has been illustrated and described with reference to a plurality of preferred embodiments thereof, it is in no way limited by the recitation of such a plurality of embodiments, but is capable of numerous modifications within the appended claims.

What is claimed is:

1. A mixture consisting of from 3–99 per cent, by weight, of a synthetic tenside having the general formula

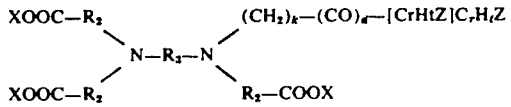

wherein $R_2$ is an alkyl radical having from 1–3 carbon atoms, $R_3$ is an alkyl radical having from 2–4 carbon atoms, $k$ is an integer from 0–20, $d$ is an integer from 0–1, $r$ is an integer from 6–30, $t$ is an integer from 8–58, Z is selected from the group consisting of H and —NH and X is selected from the group consisting of an alkali metal and hydrogen, the sum of the carbon atoms in $k$ and $C_rH_tZ$ being at least 8, the remainder of said mixture consisting of conventional detergent ingredients.

2. A mixture in accordance with claim 1 prepared by the atomization and drying of an aqueous solution comprising 10 parts, by weight, of the trisodium salt of lauryl ethylene diamine triacetic acid, 8 parts, by weight, of sodium tripolyphosphate, 5 parts, by weight, of sodium metasilicate and 14 parts, by weight, of sodium sulfate.

3. Liquid mixture in accordance with claim 1, consisting of an aqueous solution of the mono octadecylamide of ethylene diamine tetraacetic acid.

4. Liquid mixture in accordance with claim 1, consisting of a solution of 45 parts, by weight, of the trisodium salt of the monooctadecylamide of ethylene diamine tetraacetic acid in 50.6 parts, by weight, water.

* * * * *